US012209360B2

(12) United States Patent
Donahue et al.

(10) Patent No.: US 12,209,360 B2
(45) Date of Patent: Jan. 28, 2025

(54) SYNTHETIC LEATHER FABRICS

(71) Applicant: Quantum Materials, LLC, Colfax, NC (US)

(72) Inventors: Colin Donahue, Colfax, NC (US); Bett Faircloth, Colfax, NC (US); Jeffrey W Bruner, Colfax, NC (US)

(73) Assignee: Quantum Materials, LLC, Colfax, NC (US)

( * ) Notice: Subject to any disclaimer, the term of this patent is extended or adjusted under 35 U.S.C. 154(b) by 69 days.

(21) Appl. No.: 16/717,814

(22) Filed: Dec. 17, 2019

(65) Prior Publication Data

US 2020/0199812 A1 Jun. 25, 2020

Related U.S. Application Data

(60) Provisional application No. 62/783,254, filed on Dec. 21, 2018.

(51) Int. Cl.

| | |
|---|---|
| ***D06N 3/12*** | (2006.01) |
| ***D06N 3/00*** | (2006.01) |
| ***D06N 3/14*** | (2006.01) |

(52) U.S. Cl.

CPC ..... *D06N 3/123* (2013.01); *D06N 3/0006* (2013.01); *D06N 3/0027* (2013.01); *D06N 3/0036* (2013.01); *D06N 3/144* (2013.01); *D06N 2203/041* (2013.01); *D06N 2203/061* (2013.01); *D06N 2211/14* (2013.01)

(58) Field of Classification Search

CPC ..... D06N 3/0006; D06N 3/123; D06N 3/144; D06N 3/0027; D06N 3/0036; D06N 3/0061; D06N 2211/14; A47C 7/282; A47C 7/32; A47C 5/02; A47C 7/287; D03D 15/283; D03D 15/533; D03D 15/56; D02G 3/32; D02G 3/326; D02G 3/328; D10B 2401/06–063

See application file for complete search history.

(56) References Cited

U.S. PATENT DOCUMENTS 3,745,041 A * 7/1973 Raymond ..... D06N 3/14 427/358
4,469,738 A * 9/1984 Himelreich, Jr. ..... A47C 7/32 264/DIG. 81

(Continued)

FOREIGN PATENT DOCUMENTS

DE 102009051867 A1 * 5/2011 ..... A47C 31/023

OTHER PUBLICATIONS

"DE102009051867_Machine Translation" is a machine translation of DE-102009051867-A1. (Year: 2009).*

(Continued)

*Primary Examiner* — Larissa Rowe Emrich
(74) *Attorney, Agent, or Firm* — Kim and Lahey Law Firm, LLC; Douglas W. Kim

(57) ABSTRACT

A woven fabric comprises a plurality of first fibers extending along a first direction, the first fibers having a first modulus of elasticity; a plurality of second fibers extending along a second direction and being woven with the plurality of first fibers, the second fibers having a second modulus of elasticity that is lower than the first modulus of elasticity; and a coating disposed over the plurality of first fibers and the plurality of second fibers. In some embodiments, the coating is a synthetic leather.

26 Claims, 1 Drawing Sheet

(56) References Cited

U.S. PATENT DOCUMENTS

| | | | | |
|---|---|---|---|---|
| 2001/0002971 | A1* | 6/2001 | Kittson | D03D 15/56 405/21 |
| 2002/0088501 | A1* | 7/2002 | Bruner | D03D 27/00 139/2 |
| 2002/0114925 | A1* | 8/2002 | Balz | D06N 3/14 428/151 |
| 2003/0096547 | A1* | 5/2003 | Oka | D03D 15/56 442/306 |
| 2004/0121684 | A1* | 6/2004 | Haun | A47C 7/32 442/209 |
| 2009/0081409 | A1* | 3/2009 | Salzmann | B68G 7/05 428/113 |
| 2015/0147517 | A1* | 5/2015 | Salzmann | B60N 2/5891 428/90 |
| 2016/0206102 | A1* | 7/2016 | Aldrich | A47C 7/282 |
| 2017/0167061 | A1* | 6/2017 | Date | D01D 5/32 |

OTHER PUBLICATIONS

"Woven Fabric." Complete Textile Glossary, New York, NY: Celanese Acetate, 2001. N. pag. Print. (Year: 2001).*

* cited by examiner

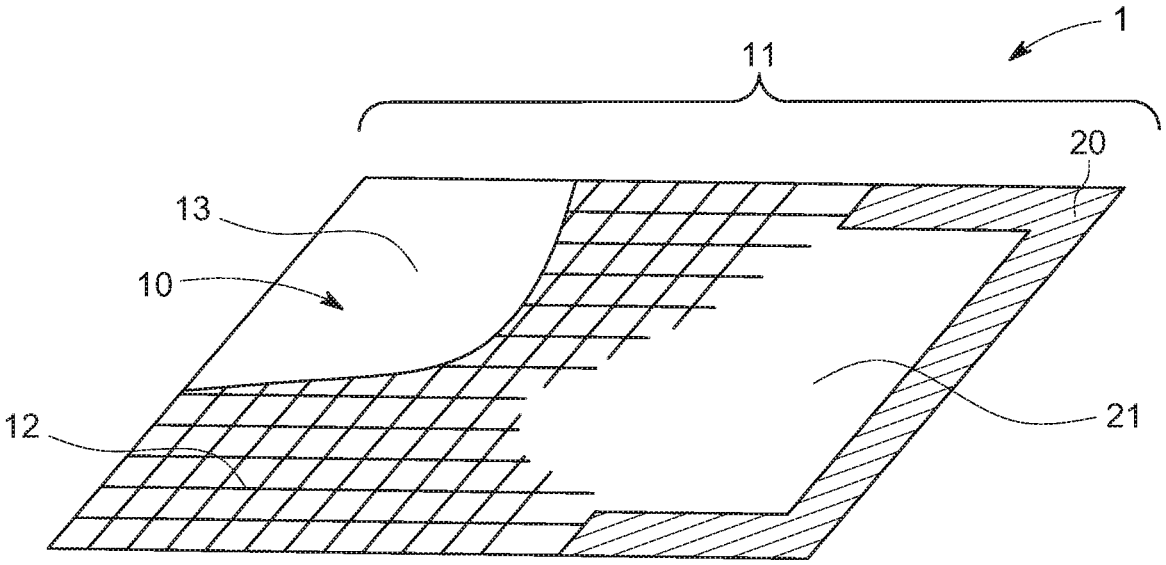
1
11
20
13
10
12
21

SYNTHETIC LEATHER FABRICS

CROSS-REFERENCE TO RELATED APPLICATIONS

This application claims priority under 35 U.S.C. § 119(e) to U.S. Provisional Patent Application No. 62/783,254, filed on Dec. 21, 2018, the entirety of which is incorporated by reference here.

FIELD

The invention is generally related to woven fabrics for seating, and more specifically, to woven fabrics having a synthetic leather coating.

BACKGROUND

Typical chairs and seats are constructed from single or multi-density foam padding or springs to provide support for a covering, such as a fabric or leather. In practice, the foam padding acts as a deformable cushion that can adjust its shape to conform to a user's body when the user is sitting in the chair. While this deformation can provide some comfort to a user, it can also create areas having different cushioning densities depending on the level of deformation of the foam material. For instance, a user's body will create areas or zones in the foam padding that are more compressed, and therefore less soft than other areas, resulting in uneven cushioning and creating pressure points. Similarly when using springs, some springs will be compressed more than others when a user is sitting, creating uneven distribution of pressure points on the user. Ultimately, the user will experience discomfort sitting in one position, and will have to periodically shift their position in order to shift the location of the pressure points. Additionally, foam padding and springs add weight to the chair, which can increase operating costs in certain applications, such as in aviation, where additional weight increases fuel costs. Therefore there is a need for improved designs in the seating.

SUMMARY

Woven fabrics and apparatus having woven fabrics are described herein. Generally, the woven fabrics are elastic in two or more directions, and can be used in seating apparatus that do not use foam supports or springs to provide support to a woven fabric that is serving as an exposed seating surface upon which a user can sit. In an aspect described in more detail herein, a woven fabric comprises a plurality of first fibers, a plurality of second fibers, and a coating.

In some embodiments, a woven fabric comprises a plurality of first fibers extending along a first direction, the first fibers having a first modulus of elasticity; a plurality of second fibers extending along a second direction and being woven with the plurality of first fibers, the second fibers having a second modulus of elasticity that is lower than the first modulus of elasticity; and a coating disposed over the plurality of first fibers and the plurality of second fibers. The first direction can be a warp direction or a weft direction, and the second direction can be the other of the warp direction or the weft direction. In some instances the first direction is a warp direction, and the second direction is a weft direction. In other instances, the first direction is a weft direction and the second direction is a warp direction.

In some cases, a woven fabric described herein is elastic in both a warp direction and a weft direction. In an embodiment, the woven fabric is more elastic in the warp direction than the weft direction. However, in some embodiments, the woven fabric is more elastic in the weft direction than the warp direction. The first modulus of elasticity can be any value not inconsistent with the objectives of this disclosure. The second modulus of elasticity can be any value not inconsistent with the objectives of this disclosure. Additionally, in some instances, a ratio of the first modulus of elasticity to the second modulus of elasticity is at least 1.1 to 1.

In some embodiments, the woven fabric is a flat fabric. Such a woven fabric can be flat on a single surface, or can be flat on both of two opposite or opposing surfaces.

A coating described herein can, in some instances, be an artificial, synthetic, or faux leather coating formed from a polyurethane, a polyvinyl, or a combination thereof. In some cases, the coating is a composite leather formed from ground leather and a binder. The coating can be applied to an exterior facing surface of the woven fabric, impregnated into the woven fabric, or be coated on one or more surfaces and impregnated into woven fabric. In some instances, the coating can further comprise a colorant, a flame retardant, an antimicrobial, an infrared emitter, an electrical conducting material, or any combination thereof.

An exterior surface of a coating described herein can be printed, imprinted, or embossed with a leather grain pattern.

In some embodiments, a woven fabric described herein can further comprise a top coat disposed over the coating. The top coat can be formed from a polyurethane, a polyvinyl, a polyamide, a polyester, a polyolefin, a polyacrylic, or any combination thereof First fibers and/or the second fibers described herein can comprise monofilament fibers, bicomponent fibers, tricomponent fibers, or any combination thereof. A first fiber described herein can be formed from a polyamide, a polyester, a polyethylene, a polypropylene, a polybutylene, a polyacrylic, or any combination thereof. A second fiber described herein can be formed from a polyamide, a polyester, a polyethylene, a polypropylene, a polybutylene, a polyacrylic, or any combination thereof. The first fibers can be woven with the second fibers in a plain weave, crowfoot weave, twill weave, satin weave, or with any weave construction not inconsistent with the goals of this disclosure. In some embodiments, the first fibers can have a denier of 300-3000, and the second fibers can have a denier of 300-3000.

In some instances, a woven fabric described herein can comprise a plurality of electrically conducting fibers extending along a warp direction, a weft direction, or both the warp and weft directions.

Moreover, and in some aspects, a woven fabric described herein can have a plurality of first fibers extending along a warp direction, each first fiber having a first modulus of elasticity and comprising a thermoplastic polyester elastomer fiber; a plurality of second fibers extending along a weft direction and being woven with the plurality of first fibers to work a substantially flat woven fabric, each second fiber having a second modulus of elasticity that is lower than the first modulus of elasticity and comprising a polyester and a thermoplastic polyester elastomer fiber, the flat woven fabric being elastic in both the warp direction and the weft direction and being more elastic in the warp direction than the weft direction; and a coating disposed over the plurality of first fibers and the plurality of second fibers, the coating being an artificial, synthetic, or faux leather. In this embodiment, the first direction is a warp direction, and the first fibers are formed from a thermoplastic polyester elastomer fiber; the second direction is a weft direction, and the second fibers are formed from a polyester and a thermoplastic polyester elastomer fiber; the woven fabric has a substantially flat surface, is elastic in both the warp direction and the weft direction, and is more elastic in the warp direction than the weft direction; and the coating is a composite leather or a faux leather.

In another aspect, a seating structure comprises a woven fabric described herein, where the woven fabric forms an exposed seating surface. In some instances, the seating structure further comprises a framing member having an opening therethrough, and the woven fabric is supported by the framing member across the opening to form the exposed seating surface. The woven fabric can extend under tension in one or more directions across the opening of the framing member. In a preferred embodiment, an exposed seating surface of the woven fabric is supported by the framing member in the absence of foam supports or springs, and provides support for a user seated on the exposed seating surface.

In another aspect, a method of making a woven fabric described herein comprises weaving a plurality of first fibers with a plurality of second fibers to form a flat fabric, the first fibers extending along a warp direction and the second fibers extending along a weft direction; applying a coating to a surface of the flat fabric; and forming a pattern on the applied coating.

In an embodiment, the step of forming a pattern on the coating comprises embossing, imprinting, or printing. In some cases, the pattern formed on the coating is a leather grain pattern or texture.

These and other embodiments are described in detail in the detailed description that follows.

BRIEF DESCRIPTION OF THE DRAWINGS

FIG. 1 is a perspective view of a partial cutaway of an exemplary seating structure having a woven fabric and a framing member.

DETAILED DESCRIPTION

Embodiments described herein can be understood more readily by reference to the following detailed description and examples. Elements and compositions described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

All ranges disclosed herein are also to be considered to include the end points of the range, unless expressly stated otherwise. For example, a range of "between 5 and 10" should generally be considered to include the end points 5 and 10.

Further, when the phrase "up to" is used in connection with an amount or quantity, it is to be understood that the amount is at least a detectable amount or quantity. For example, a material present in an amount "up to" a specified amount can be present from a detectable amount and up to and including the specified amount.

As used herein, the term "fiber" refers to a textile fiber, yarn, or filament. Similarly, "fibers" can refer collectively to fibers, yarns, and filaments.

I. Woven Fabric

In one aspect, a fabric is described herein. As described in more detailed below, the fabric can be formed by weaving. Notably, a coating can be applied to the fabric A woven fabric described herein comprises a plurality of first fibers extending along a first direction, and a plurality of second fibers extending along a second direction and being woven with the plurality of first fibers. The first fibers can be woven with the second fibers in a plain weave, crowfoot weave, twill weave, satin weave, or with any weave construction not inconsistent with the goals of this disclosure.

The first direction can be a warp direction or a weft direction, and the second direction is the other of the warp direction or the weft direction. For example, in some instances, the first direction is a warp direction, and the second direction is a weft direction, or in other instances, the first direction is a weft direction, and the second direction is a warp direction. Generally the warp direction is understood to refer to a lengthwise-, longitudinal-, or machine-direction. Weft direction generally refers to a direction transverse or crosswise to the warp direction, and can also be referred to as a "woof" direction.

In some instances, first fibers described herein have a first modulus of elasticity and second fibers described herein have a second modulus of elasticity that is lower than the first modulus of elasticity. The modulus of elasticity is known as, and may be referred to as the "elastic modulus" or "Young's modulus" or "initial modulus," in some cases. Elastic modulus generally describes the elastic properties of a solid undergoing tension or compression in one direction, and measures an ability of a material to withstand changes in length when under lengthwise tension or compression. Materials having a relatively high elastic modulus display relatively low elongation compared to materials having a relatively low elastic modulus, which display relatively high elongation. Thus, in embodiments described herein where the second fibers have a higher elastic modulus as compared to the first fibers, the first fibers will display higher "elasticity" (in terms of stretchability, not stiffness) and elongation than the second fibers. The modulus of elasticity (Young's modulus) can be determined in any manner not inconsistent with the objectives of this disclosure. In some cases, the modulus of elasticity can be determined under ASTM D2256-02. For example, the modulus of elasticity values described herein were particularly determined using an Instron model 3345 under ASTM D2256-02 conditions, where the selected gauge length was 10 in (+/−0.1 in) with a speed of 10 in/min (the readout selected was the "Automatic Young's Modulus"). The first modulus and/or the second modulus of elasticity can have a value of 1 to 65 gf/den, 1 to 55 gf/den, 1 to 45 gf/den, 1 to 35 gf/den, 1 to 25 gf/den, 1 to 15 gf/den, 1 to 12 gf/den, 1 to 10 gf/den, 1 to 7.5 gf/den, 1 to 7 gf/den, 1 to 5 gf/den, 1 to 3 gf/den, 1 to 2 gf/den, 3 to 7.5 gf/den, 3 to 7 gf/den, 3 to 5 gf/den, 11 to 60 gf/den, 12 to 55 gf/den, 16 gf/den to 55 gf/den, 22 to 55 gf/den, 25 to 55 gf/den, 32 to 55 gf/den, 33 to 55 gf/den, 11 to 33 gf/den, 11 to 25 gf/den, 11 to 22 gf/den, 11 to 16 gf/den, or 10 to 12 gf/den. More specifically, in some embodiments, the first modulus of elasticity (e.g., for a warp direction) has a value of 1-10 gf/den, 2-10 gf/den, 3-8 gf/den, 3-7.5 gf/den, 5-10 gf/den, or 5-8 gf/den; and the second modulus of elasticity (e.g., for a weft direction) has a value of 10-60 gf/den, 10-55 gf/den, 10-45 gf/den, 10-35 gf/den, 12-55 gf/den, 12-35 gf/den, or 16-35 gf/den. In some embodiments, the second modulus of elasticity has a value of 11 gf/den, 12 gf/den, 16 gf/den, 22 gf/den, 25 gf/den, 32 gf/den, 33 gf/den or 56 gf/den; and the first modulus of elasticity has a value of 3 gf/den, 5 gf/den, 6 gf/den, 7 gf/den, or 8 gf/den.

A ratio of the first modulus of elasticity to the second modulus of elasticity can be any value not inconsistent with the objectives of this disclosure. In some instances, a ratio of the first modulus of elasticity to the second modulus of elasticity is between 1:20 and 1:2, or between 1:15 and 1:5. In some embodiments, the ratio of the first modulus of elasticity to the second modulus of elasticity is between 1:2 and 1:5, between 1:3 and 1:5, between 1:5 and 1:10, or between 1:15 and 1:20. In some preferred embodiments, the ratio of the first modulus of elasticity to the second modulus of elasticity is about 1:4.

In some embodiments, a woven fabric described herein can be a flat fabric. The term "flat" is understood to mean that one or both of the two opposite, exterior facing surfaces is substantially planar. While not intending to be bound by theory, it is believed that a coating described herein can more easily be applied to a surface of a woven fabric described herein when the surface is substantially flat. In other words, the flatness of the surface can in some cases make the woven fabric easier to coat.

A woven fabric described herein can be elastomeric or elastic in both a warp direction and a weft direction. In some embodiments, when a woven fabric has first fibers extending in the warp direction and second fibers extending in the weft direction, where the first fibers have a higher elastic modulus as compared to the elastic modulus of the second fibers, the woven fabric is more elastomeric or elastic in the weft direction than the warp direction. In embodiments, where a woven fabric has first fibers extending in the warp direction and second fibers extending in the weft direction, where the first fibers have a lower elastic modulus as compared to the elastic modulus of the second fibers, the woven fabric is more elastomeric or elastic in the warp direction than the weft direction.

First fibers and/or second fibers described herein can comprise monofilament fibers, bicomponent fibers, tricomponent fibers, or any combination thereof. The first fibers and the second fibers can be formed from any polymer or material not inconsistent with the objectives of this disclosure, such a fibers having the different physical properties described herein. In some embodiments, the first fibers can be formed from polymers or combination of polymers that are different than the second fibers. The first fibers and second fibers can be natural or synthetic fibers, and be synthesized via any suitable method not inconsistent with the objectives of this disclosure. In some embodiments, first fibers described herein can comprise or be formed from a polyamide, such as a nylon; a polyester; a polyolefin, such as a polyethylene, a polypropylene, or a polybutylene; a polyacrylic; or any combination thereof. In some instances, first fibers described herein can comprise or be formed from a Thermoplastic Polyester Elastomer (TPC-ET), such as a Hytrel® fiber produced by E.I. DuPont DeNemours Company. As understood herein, TPC-ET are high performance, high temperature copolyester elastomers (COPE) that can combine the properties of both thermoplastics and elastomers rubbers. Further exemplary first fibers can comprise a styrenic block copolymer (TPS), a thermoplastic polyolefinelastomer (TPO), a thermoplastic vulcanizate (TPV), a thermoplastic polyurethane (TPU), a thermoplastic copolyester (TPC), or a thermoplastic polyamide (TPA). In some embodiments, second fibers described herein can comprise or be formed from a polyamide, such as a nylon; a polyester; a polyolefin, such as a polyethylene, a polypropylene, or a polybutylene; a polyacrylic; or any combination thereof. In some instances, second fibers described herein can comprise a polyester and a thermoplastic polyester elastomer, and can be a mixture of monofilament fibers, or bicomponent fibers, such as a sheath/core filament. In some cases, exemplary second fibers can comprise a TPC-ET, a styrenic block copolymer (TPS), a thermoplastic polyolefinelastomer (TPO), a thermoplastic vulcanizate (TPV), a thermoplastic polyurethane (TPU), a thermoplastic copolyester (TPC), or a thermoplastic polyamide (TPA), the second fiber being different from the first fiber.

Moreover, the first fibers and second fibers can have any size, shape, and/or denier not inconsistent with the objectives of this disclosure. In some instances, the first fibers can have a denier of 300-3000, 500-3000, 700-3000, 900-3000, 1000-3000, 1200-3000, 1400-2900, 1600-2500, 1800-2200, 1200-2200, 1200-1800, 1600-3000, 1400-1800, 300-2000, 300-1500, 300-1200, 300-1000, 300-800, 300-500, 500-1000, 500-750, 750-1500, or 700-1300. The second fibers can in some cases have a denier of 300-3000, 500-3000, 700-3000, 900-3000, 1000-3000, 1200-3000, 1400-2900, 1600-2500, 1800-2200, 1200-2200, 1200-1800, 1600-3000, 1400-1800, 300-2000, 300-1500, 300-1200, 300-1000, 300-800, 300-500, 500-1000, 500-750, 750-1500, or 700-1300. In some embodiments, the first and second fibers can have approximately the same denier, or, in other instances, can have different deniers. For example, in some embodiments where the first and second fibers have a different modulus of elasticity, the fibers with the higher modulus of elasticity can have a smaller denier than the other fibers with a lower modulus of elasticity. In other cases, where the first and second fibers have a different modulus of elasticity, the fibers with the lower modulus of elasticity can have a smaller denier than the other fibers with a higher modulus of elasticity In some embodiments, a woven fabric described herein can comprise a plurality of electrically conducting fibers. An electrically conducting fiber can extend along a warp direction, a weft direction, or both the warp and weft directions. The electrically conducting fibers can be bundled together with the first fibers and/or second fibers in the form of a yarn, or the first fibers and/or second fibers can themselves be an electrically conducting fiber. When the first fibers and/or second fibers are themselves an electrically conducting fiber, the first fibers and/or second fibers can comprise an electrically conducting fiber component. For example, a first fiber or second fiber could be a bi- or tri-component fiber, where one of the components of the fiber is formed or comprises an electrically conducting material. When the woven fabric described herein comprises or is formed from electrically conducting fibers, the electrically conducting fibers can comprise up to 1 wt. %, 1-100 wt %, 1-5 wt. %, 3-8 wt. %, 5-10 wt. %, up to 20 wt. %, up to 30 wt. %, up to 40 wt %, up to 50 wt. %, up to 60 wt. %, up to 70 wt. %, up to 80 wt. %, up to 90 wt %, or greater than 90 wt. % based on a total weight of the woven fabric without a coating.

A coating can be disposed over at least one surface of a woven fabric described herein, such as over the plurality of first fibers and the plurality of second fibers comprising the woven fabric. In some cases, the coating can be disposed over two exterior facing surfaces of a woven fabric, such as two opposite sides of the woven fabric. Additionally, the coating can in some instances be disposed over at least one surface of a woven fabric, and also be impregnated within the weave of the woven fabric.

In some preferred embodiments, a coating described herein is a synthetic, artificial, or faux leather coating. In some instances, a synthetic leather coating is formed from or comprises a polyurethane, a polyvinyl, a silicone, a combination thereof, or any other suitable, known material not inconsistent with the objectives of this disclosure. In other cases, a coating described herein can be formed from a composite comprising ground up leather and a binder. The binder can comprise any polymer or resin not inconsistent with the objectives of this disclosure, and in some instances, comprises a polyurethane, a polyvinyl, and/or a silicone. The synthetic leather coating and/or the composite leather binder can be elastic or elastomeric, having a modulus of elasticity complementary or similar to the materials forming the first fibers and/or second fibers. Thus, when a woven fabric described herein is stretched in the warp and/or weft directions, the coating will also stretch without cracking or damaging the coating.

In some embodiments, a coating described herein can further comprise a colorant, a flame retardant, an antimicrobial, an infrared emitter, electrically conducting materials, or any combination thereof. Any colorant not inconsistent with the objectives of this disclosure can be used, and can include pigments, dyes, and other colorants known in the art. Any antimicrobial not inconsistent with the objectives of this disclosure can be used. An infrared emitter not inconsistent with the objectives of this disclosure can be used. Exemplary infrared emitters can include ceramics, minerals, polymers, carbon-based nanomaterials, and the like that can absorb visible and/or infrared electromagnetic radiation from the human body and reemit this absorbed radiation as infrared electromagnetic radiation. In one particular embodiment, infrared emitters can comprise Celliant® branded emitters made by Hologenix, LLC of Santa Monica, CA. In some instances, the re-emitted infrared electromagnetic radiation is in the far infrared region, having a wavelength of approximately 15 m to 1 mm. Any electrically conducting material not inconsistent with the objectives of this disclosure can be used. For instance, in some embodiments the electrically conducting material is a carbon-based nanomaterial, such as a carbon nanotube or graphite.

Additionally, in some instances, a coating described herein can have an exterior facing surface that has a leather grain pattern. The leather grain pattern can in some cases be printed on the exterior facing surface using an ink, dye, pigment, or other known printing materials. In other cases, a coating described herein can have an exterior facing surface that is imprinted, embossed and/or debossed with a leather grain surface texture or pattern. As is known in the art, an embossed surface has a raised or recessed relief or design where a pattern is raised against a background of the coating material or recessed into a surface of the coating material. The embossed surface of the coating can be formed using any embossing technique not inconsistent with the objectives of this disclosure, such as the use of an embossing roller, pin, or stamping die.

An optional top coat can be disposed over a coating described herein. A top coat can be disposed, applied, or positioned over the coating to provide for increased stain resistance or color fastness of the woven fabric and coating. A top coat described herein can comprise any material not inconsistent with the objectives of this disclosure. For example, the top coat can be formed from a polyurethane, a polyvinyl (such as a soft PVC), a nylon or another polyamide, a polyester, polyethylene, polypropylene, polybutylene, or another polyolefin, a polyacrylic, or any combination thereof. In some embodiments, the top coat comprises a flame retardant additive, such that the top coat is a fire resistant film. Any flame retardant additive not inconsistent with the objectives of this disclosure can be used. The flame retardant additive can be the same or different from the flame retardant optionally used in a coating described herein.

II. Seating Structure

In another aspect, seating structures are described herein. A seating structure described herein can have one or more benefits or advantages over other seating structures. For example, a seating structure described herein can be used to make a seat or a chair that does not use foam or springs to provide support or cushioning to the woven fabric when a user sits in the seat or chair. In some embodiments, a seating structure comprises a woven fabric described in Section I.

FIG. 1 shows a partial cutaway perspective of an exemplary seating structure 1 that comprises a woven fabric 10 described in Section I, and a framing member 20 having an opening 21 therethrough. The woven fabric 10 is positioned across the opening 21 and forms an exposed seating surface 11. First fibers and second fibers described in Section I are indicated by reference number 12, and a coating described in Section I is indicated by reference number 13.

In some embodiments, the woven fabric 10 extends under tension in one or more directions across the opening of the framing member 20. For example, in some cases, the woven fabric 10 is prestretched/pretensioned between 1-5%, 1-10%, 1-15%, 1-20%, 3-5%, 6-9%, 9-12%, or less than 10% elongation in the weft direction, warp direction, or in both the weft and warp directions prior to being positioned on the framing member 20. In some embodiments, the woven fabric 10 can be prestretched/pretensioned at different elongation percentages in the weft direction and the warp direction to produce a desired pressure distribution over the exposed seating surface 11. By adjusting the elongation percentages and ratios of the woven fabric in the weft and warp directions, the exposed seating surface 11 can be tuned to conform to a shape of a user's body, such as the user's buttocks and/or back, and conform to natural movements of the user's body.

While not shown in the FIGURE, the woven fabric 10 can be fastened to the framing member 20 in any manner not inconsistent with the objectives of this disclosure, such that the woven fabric 10 can be held in a stretched/tensioned state. Additionally or alternatively, the woven fabric 20 can be fastened to another component of the seat or chair to hold the woven fabric 10 in a stretched/tensioned state.

III. Method of Making a Woven Fabric

Methods of making a woven fabric are also disclosed. Such methods are used to make or construct any of the woven fabrics described in Section I.

In one aspect, a method of making a woven fabric comprises weaving a plurality of first fibers with a plurality of second fibers to form a flat fabric, the first fibers extending along a warp direction and the second fibers extending along a weft direction; applying a coating to a surface of the flat fabric; and optionally forming a pattern on the applied coating.

In some embodiments, the coating can be applied to one or more surfaces of the flat fabric in any manner not inconsistent with the objectives of this disclosure. While not intended to be limiting, exemplary methods include spray coating, dipping, hot melting, laminating, and the like.

In some instances, a pattern is formed on the applied coating by printing a surface of the coating with an ink, dye, pigment, or other suitable printing material using a printer. In other instances, a pattern is formed on the applied coating by passing the coated, woven fabric through or over one or more embossing rollers, or by stamping the applied coating with an embossing stamp. In some embodiments, the pattern is a leather grain pattern or texture.

Various embodiments of the present invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A woven fabric comprising:

a plurality of first fibers extending along a first direction, the first fibers having a first modulus of elasticity, wherein the first modulus of elasticity is from about 1-10 gf/den;

a plurality of second fibers extending along a second direction and being woven with the plurality of first fibers, the second fibers having a second modulus of elasticity that is higher than the first modulus of elasticity, wherein the second modulus of elasticity is from about 10-60 gf/den; and a coating disposed over the plurality of first fibers and the plurality of second fibers.

2. The woven fabric of claim 1, wherein the first direction is a warp direction or a weft direction, and the second direction is the other of the warp direction or the weft direction.

3. The woven fabric of claim 1, wherein the first direction is a warp direction, and the second direction is a weft direction.

4. The woven fabric of claim 1, wherein the woven fabric is elastic in both a warp direction and a weft direction.

5. The woven fabric of claim 4, wherein the woven fabric is more elastic in the warp direction than the weft direction or wherein the woven fabric is more elastic in the weft direction than the warp direction.

6. The woven fabric of claim 1, wherein the ratio of the first modulus of elasticity to the second modulus of elasticity is between 1:20 and 1:2.4.

7. The woven fabric of claim 1, wherein the woven fabric is a flat fabric.

8. The woven fabric of claim 1, wherein the coating is a synthetic leather coating formed at least in part from a polyurethane, a polyvinyl, a silicone, or a combination thereof.

9. The woven fabric of claim 1, wherein the coating is formed from ground leather and a binder.

10. The woven fabric of claim 1, wherein the coating further comprises a colorant, a flame retardant, an antimicrobial, an infrared emitter, electrically conducting material, or any combination thereof.

11. The woven fabric of claim 1, wherein an exterior surface of the coating has an embossed leather grain texture.

12. The woven fabric of claim 1, wherein an exterior surface of the coating has a leather grain surface pattern.

13. The woven fabric of claim 1, further comprising a top coat disposed over the coating.

14. The woven fabric of claim 13, wherein the top coat is formed from polyurethane, a polyvinyl, a polyamide, a polyester, a polyolefin, a polyacrylic, a silicone, or any combination thereof.

15. The woven fabric of claim 1, wherein the first fibers and/or the second fibers comprise monofilament fibers, bicomponent fibers, tricomponent fibers, or any combination thereof.

16. The woven fabric of claim 1, wherein the first fibers are formed from a polyamide, a polyester, a polyethylene, a polypropylene, a polybutylene, a polyacrylic, or any combination thereof.

17. The woven fabric of claim 1, wherein the second fibers are formed from a polyamide, a polyester, a polyethylene, a polypropylene, a polybutylene, a polyacrylic, or any combination thereof.

18. The woven fabric of claim 1, further comprising a plurality of electrically conducting fibers along a warp direction, a weft direction, or both the warp and weft directions.

19. The woven fabric of claim 1, wherein the first fibers are woven with the second fibers in a plain weave, crowfoot weave, twill weave, or satin weave.

20. The woven fabric of claim 1, wherein the first fibers have a denier of 300-3000 and the second fibers have a denier of 300-3000.

21. The woven fabric of claim 1, wherein the first direction is a warp direction, and the first fibers are formed from a thermoplastic polyester elastomer fiber;

wherein the second direction is a weft direction, and the second fibers are formed from a polyester and a thermoplastic polyester elastomer fiber;

wherein the woven fabric has a substantially flat surface, is elastic in both the warp direction and the weft direction; and wherein the coating is a composite leather or a synthetic leather.

22. A seating structure comprising the woven fabric of claim 1.

23. The seating structure of claim 22, wherein the woven fabric forms an exposed seating surface.

24. The seating structure of claim 23, wherein the seating structure further comprises a framing member having an opening therethrough, and the woven fabric is supported by the framing member across the opening to form the exposed seating surface.

25. The seating structure of claim 24, wherein the woven fabric extends under tension in one or more directions across the opening of the framing member.

26. The seating structure of claim 24, wherein the exposed seating surface of the woven fabric is supported by the framing member without foam supports or springs, and provides support for a user seated on the exposed seating surface.

* * * * *